US006253782B1

(12) United States Patent
Raghu

(10) Patent No.: US 6,253,782 B1
(45) Date of Patent: Jul. 3, 2001

(54) FEEDBACK-FREE FLUIDIC OSCILLATOR AND METHOD

(75) Inventor: Surya Raghu, Ellicott City, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 0 days.

(21) Appl. No.: 09/417,899

(22) Filed: Oct. 14, 1999

Related U.S. Application Data

(60) Provisional application No. 60/104,511, filed on Oct. 16, 1998.

(51) Int. Cl.[7] ..... F15C 1/06

(52) U.S. Cl. ..... 137/14; 137/809; 137/810; 137/811; 137/813; 137/826; 137/833; 137/835

(58) Field of Search ..... 137/826, 833, 137/835, 808, 809, 810, 811, 812, 813, 14

(56) References Cited

U.S. PATENT DOCUMENTS

| | | | | |
|---|---|---|---|---|
| 3,208,462 | * | 9/1965 | Fox et al. | 137/811 |
| 3,452,772 | * | 7/1969 | Zaloudek | 137/809 |
| 4,151,955 | | 5/1979 | Stouffer | 239/11 |
| 4,184,636 | | 1/1980 | Bauer | 239/11 |
| 4,463,904 | | 8/1984 | Bray, Jr. | 239/284 R |
| 4,508,267 | | 4/1985 | Stouffer | 239/11 |
| 4,854,176 | * | 8/1989 | Okabayashi | 73/861.19 |
| 4,976,155 | * | 12/1990 | Challandes | 73/861.19 |
| 5,213,269 | | 5/1993 | Srinath et al. | 239/589.1 |
| 5,213,270 | | 5/1993 | Stouffer et al. | 239/589.1 |
| 5,396,808 | * | 3/1995 | Huang et al. | 73/861.19 |
| 5,638,867 | * | 6/1997 | Huang | 137/826 |

FOREIGN PATENT DOCUMENTS

| | | | | |
|---|---|---|---|---|
| 1550510 | * | 3/1970 | (DE) | 137/812 |

* cited by examiner

*Primary Examiner*—A. Michael Chambers
(74) *Attorney, Agent, or Firm*—Jim Zegeer

(57) ABSTRACT

A fluidic oscillator includes a member having an oscillation inducing chamber, at least one source of fluid under pressure, at least a pair of power nozzles connected to the at least one source of fluid under pressure for projecting at least a pair of fluid jets into the oscillation chamber, and at least one outlet from the oscillation chamber for issuing a pulsating or oscillating jet of fluid to a point of utilization or ambient. A common fluid manifold connected to said at least a pair of power nozzles. The shape of the power nozzle manifold forms one of the walls of the interaction or oscillation chamber. In some of the fluidic circuits, the length can be matched to fit existing housings. The power nozzle can have offsets which produce yaw angles in a liquid spray fan angle to the left or right depending on the direction desired. In some embodiments, the exit throat is off axis (off the central axis of the symmetry) by a small fraction to the left or right to move the leftward or rightward yaw angles in the spray. The outlet throat may be offset along the longitudinal axis by a small amount to produce a yaw angle of predetermined degree to the left or right depending on what is desired. Thus, one can construct circuits for yaw using a combination of the techniques described above which suits most applications.

25 Claims, 15 Drawing Sheets

FEEDBACK-FREE FLUIDIC OSCILLATOR AND METHOD

REFERENCE TO RELATED APPLICATIONS

This application is the subject of provisional application Ser. No. 60/104,511 filed Oct. 16, 1998 and entitled FEEDBACK-FREE FLUIDIC OSCILLATOR.

BACKGROUND AND BRIEF DESCRIPTION OF THE INVENTION

Fluidic oscillators are well known in the art, some using feedback passages with wall attachment effect and without wall attachment effect (see Bray U.S. Pat. No. 4,463,904 for fluidic oscillators which utilize wall attachment and see Stouffer U.S. Pat. No. 4,508,267 for fluidic oscillators which do not depend on or use wall attachment). There are fluidic oscillators which issue an oscillating spray to ambient which do not utilize or incorporate feedback passages (see, for example, Stouffer U.S. Pat. No. 4,151,955 which utilizes an island to generate an oscillating output and Bauer U.S. Pat. No. 4,184,636 which is a reversing chamber type oscillator). In Stouffer et al U.S. Pat. Nos. 5,213,270 and 5,213,269, another type of feedback or control passage free oscillator is disclosed in which an oscillating chamber having a length greater than its width and a pair of mutually facing complementary shaped sidewalls which forms alternately pulsating, cavitation-free vortices on each side of the stream to induce oscillations at the output.

THE PRESENT INVENTION

The present invention is a fluidic oscillator of the type that is free of feedback or control passages and provides a shaped oscillation chamber having at least one outlet and at least a pair of power nozzles adapted to form a pair of liquid jets which are oriented at angles in the chamber to each other such that they interact and generate a plurality of vortices in the chamber. The plurality of vortices cause the pair of liquid jets to cyclically change their directions and combine to produce a sweeping jet of liquid at the outlet. In a preferred embodiment, the oscillating chamber has a dome- or mushroom-shaped surface, a manifold feeding the power nozzles and an outlet to ambient is in a wall opposite the dome- or mushroom-shaped surface.

Operatively, the device is based on the internal instability of two jets of liquid in a cavity. The two jets are properly sized and oriented in an interaction chamber such that the resulting flow pattern give a system of vortices which are inherently unstable and cause the two jets to cyclically change their directions. This provides a sweeping jet at the exit of the chamber. The exit outlet or aperture can be designed to produce either an oscillating sheet for area coverage or a fan type, planar spray. The power nozzles need not be symmetrically oriented relative to the central axis of the oscillation chamber. Moreover, the outlet and outlet throat can be adapted to issue a yawed sweeping jet.

Thus, the object of the invention is to provide an improved fluidic oscillator and more particularly to provide a fluidic oscillator which issues a sweeping jet of fluid or liquid to ambient.

DESCRIPTION OF THE DRAWINGS

The above and other objects, advantages and features of the invention will become more apparent when considered with the following specification and accompanying drawings wherein.

DETAILED DESCRIPTION OF THE INVENTION

The fluidic oscillator of the present invention is based on the internal instability of two jets of liquid or fluid in a cavity. The two liquid jets or streams are properly sized and oriented in an interaction region (also called the oscillation chamber) such that the resulting flow pattern is a system of vortices that is inherently unstable and causes the two jets to cyclically change their direction. This produces a sweeping jet at the exit or outlet of the chamber. The exit or outlet EX geometry is designed to produce either an oscillating sheet for area coverage or a fan-type, planar spray.

Figure 1:
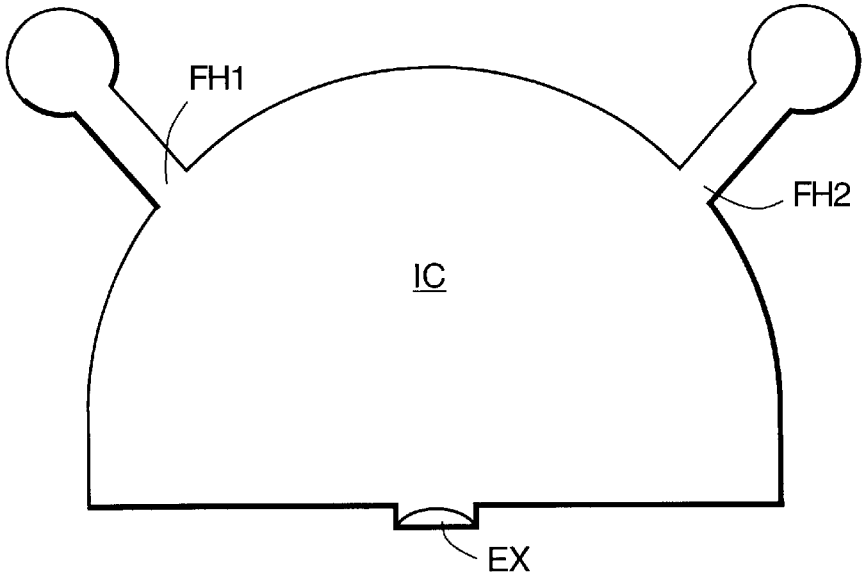
FIG. 1 illustrates a basic configuration of the invention.
Figure 2A:
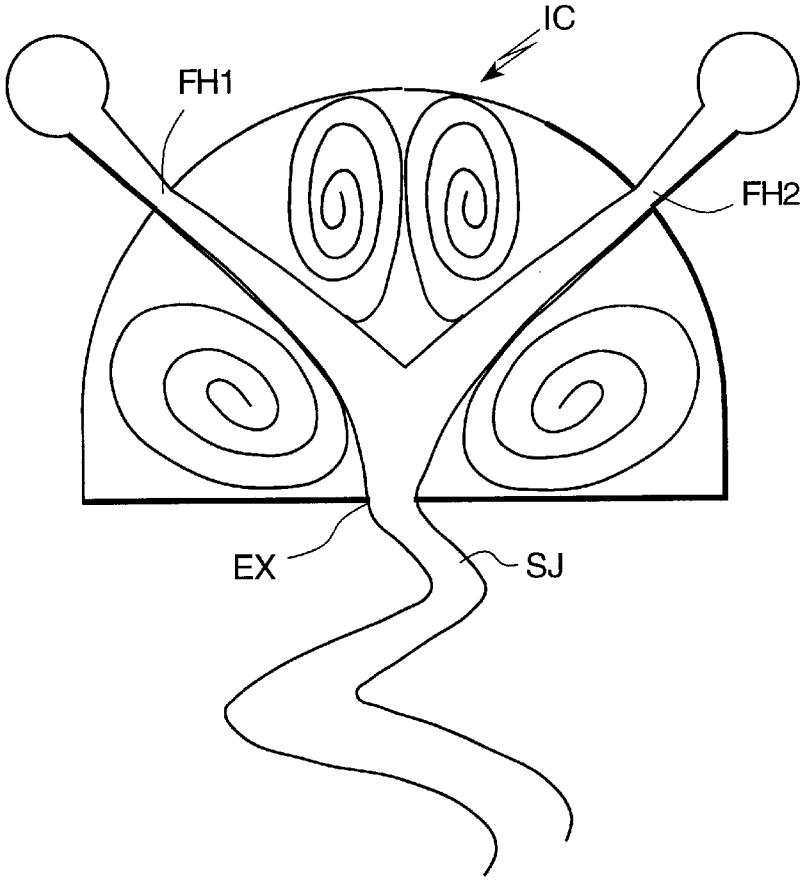
FIGS. 2A, 2B and 2C illustrate a sweeping jet at the exit of the fluidic oscillator shown in FIG. 1.
Figure 2B:
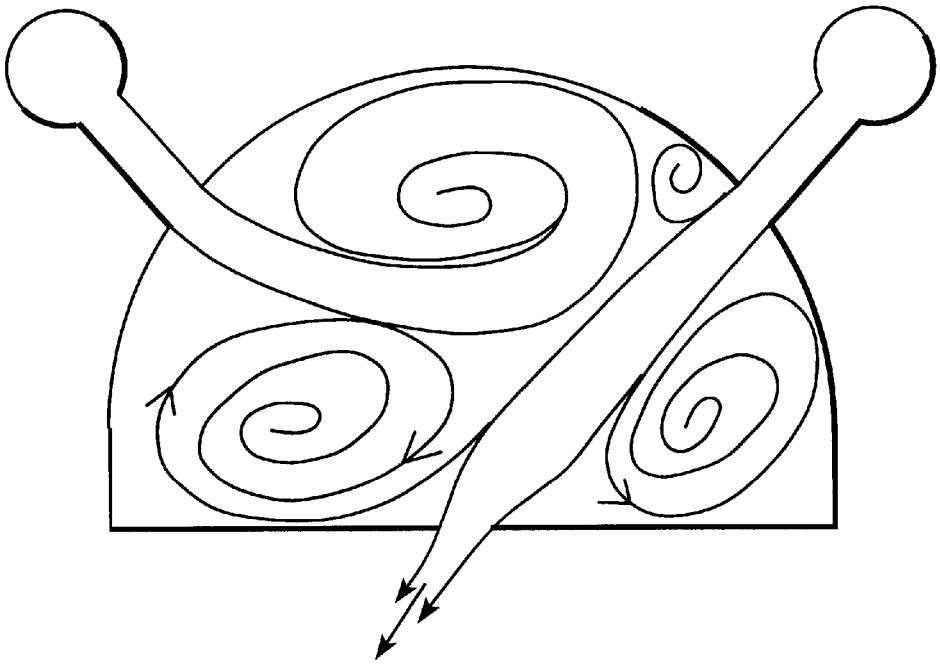
Figure 2C:
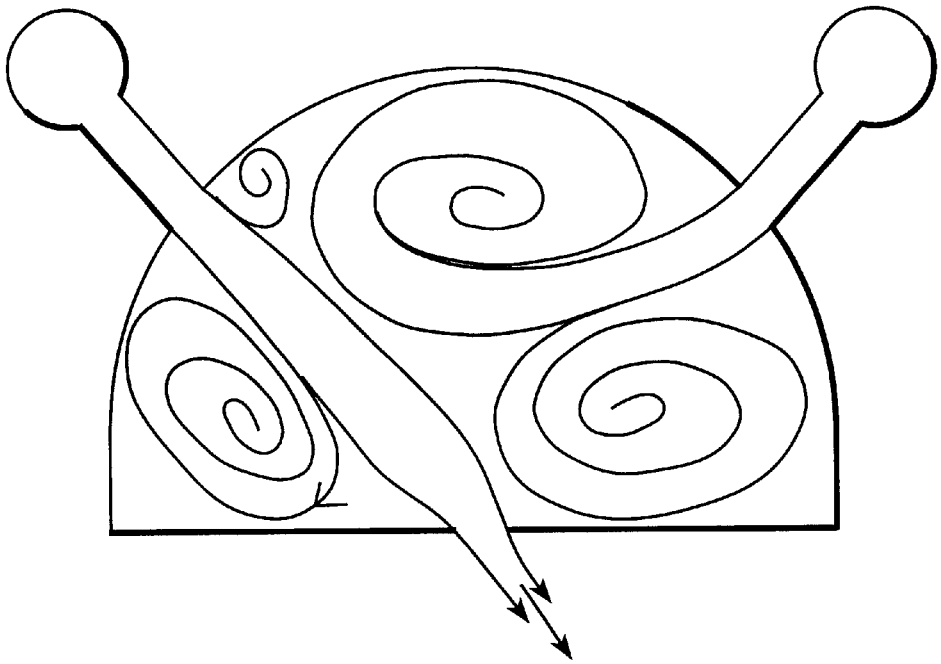

The basic configuration is illustrated in FIG. 1 and comprises an interaction chamber IC having multiple power nozzles PN1 and PN2. The flow in the chamber creates a four-vortex system (see FIG. 2) that is inherently unstable. This results in a sweeping jet SJ at the exit or outlet aperture as shown in FIG. 2.

Figure 3:
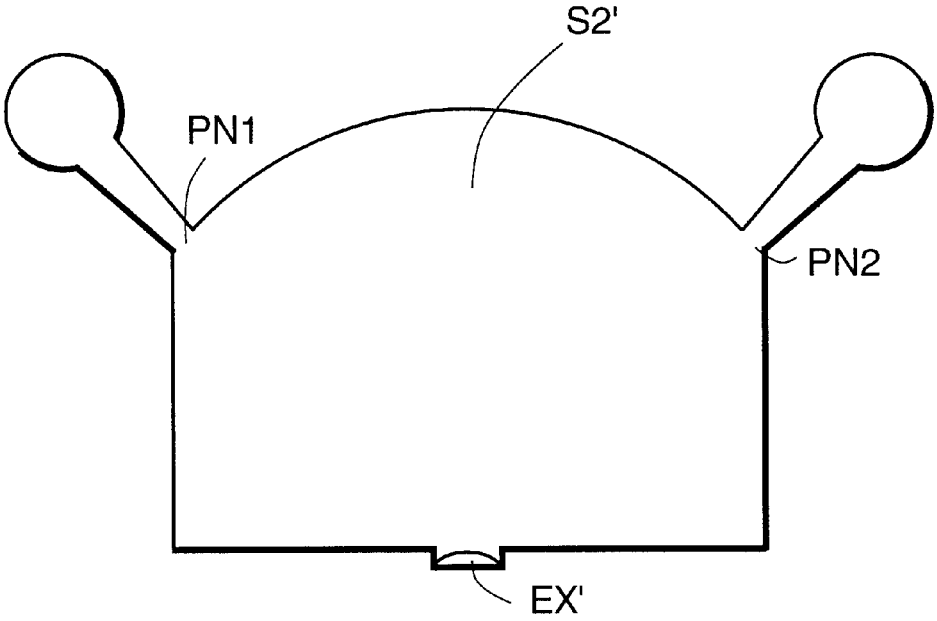
FIG. 3 is a further embodiment of the invention in which the corners of the oscillation chamber are straightened.
Figure 4:
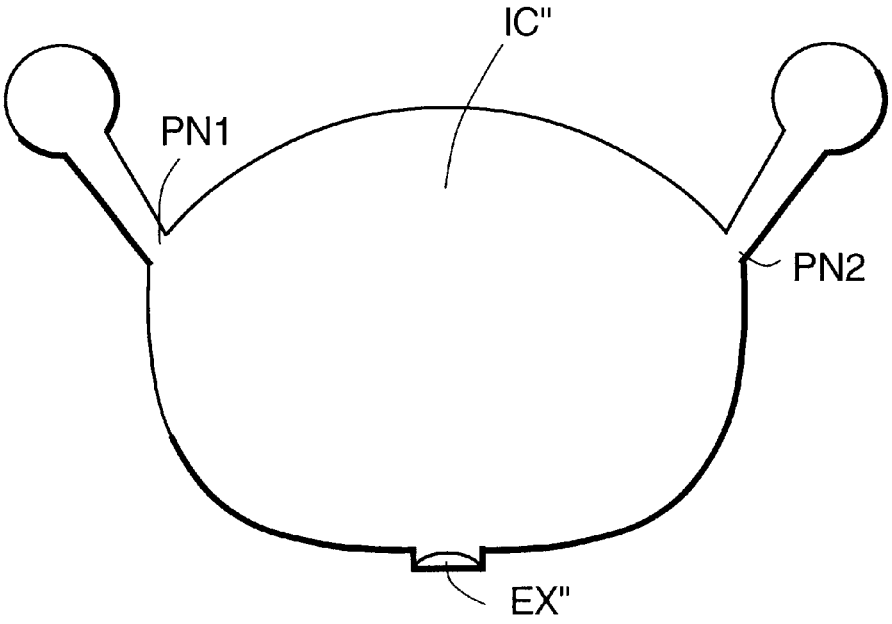
FIG. 4 is a further embodiment of the invention wherein the oscillation chamber is modified to be in an oval shape.
Figure 5A:
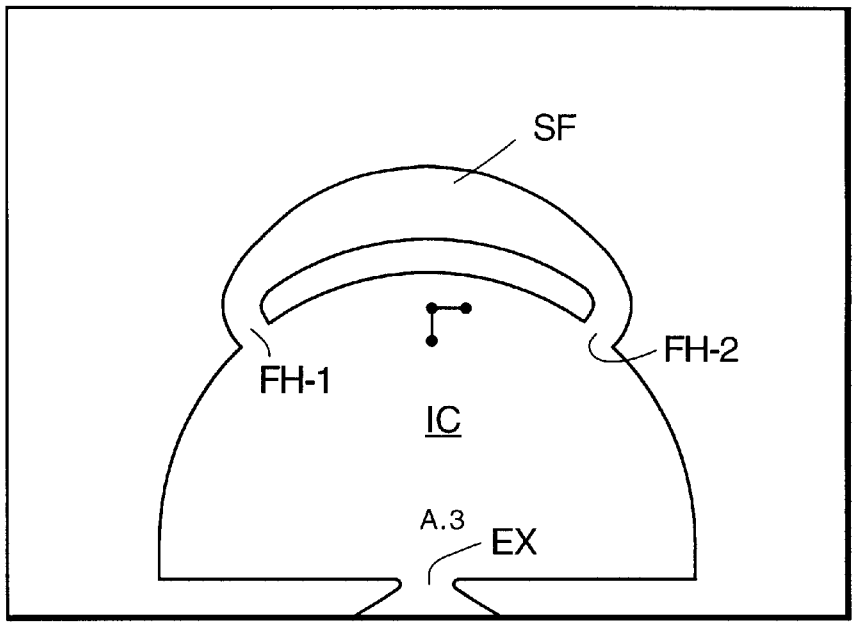
FIGS. 5A, 5B (which is an isometric perspective view of FIG. 5A) and 6 disclose embodiments wherein a single feed configuration is used in the internal geometry divides the flow into two jets.
Figure 5B:
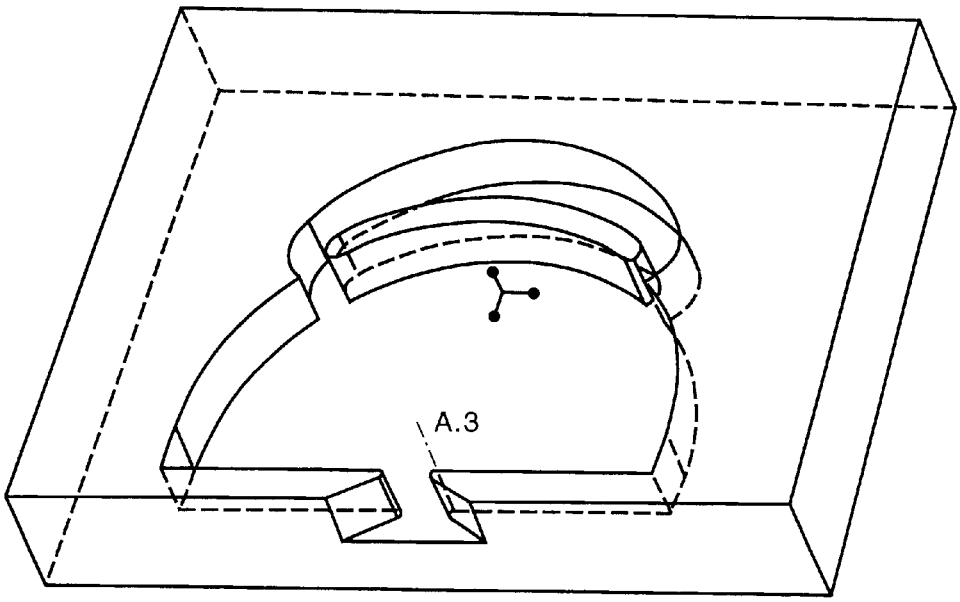
Figure 6:
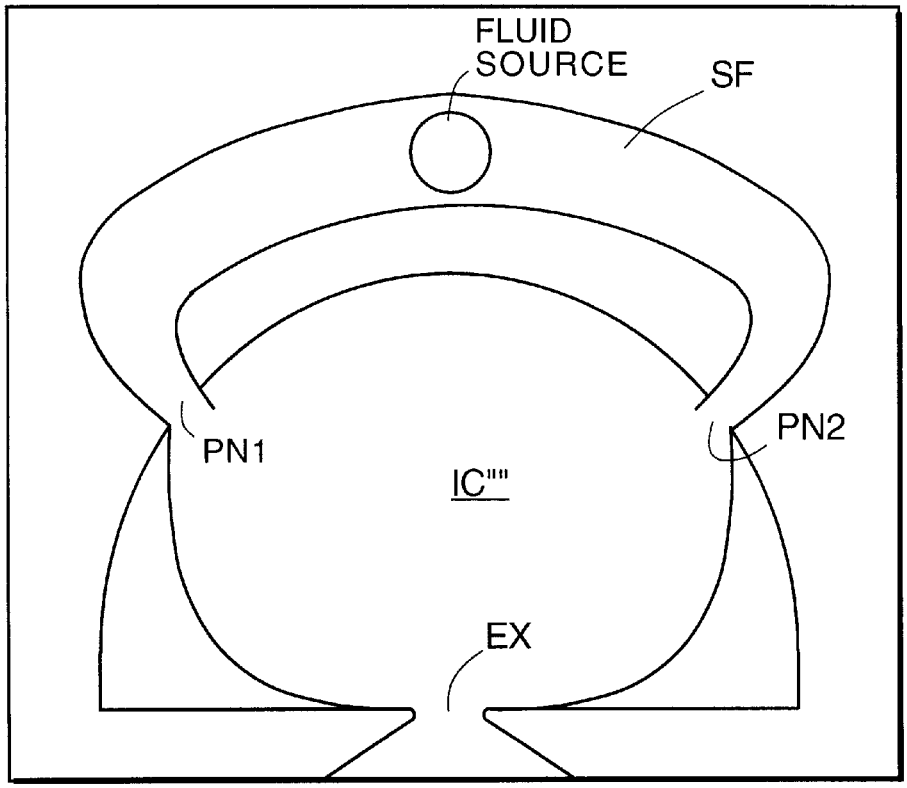

In FIG. 3, the corners of the interaction chamber IC' have been straightened as indicated, and in FIG. 4 the chamber IC" is modified to be in an oval shape. In FIGS. 5 and 6, a single-feed manifold SF is used with the internal passages (i.e. the internal geometry divides the flow into two jets).

Figure 7:
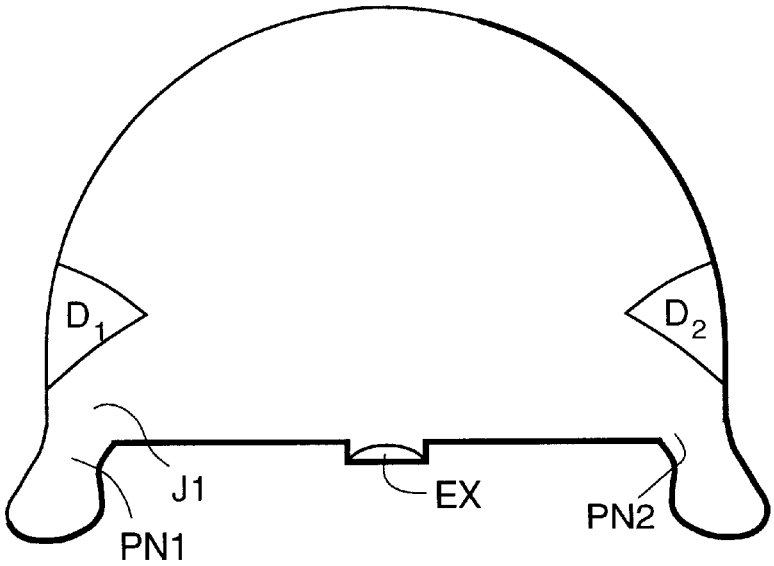
FIG. 7 illustrates the location of the jets angled and oriented in the direction of the dome-shaped wall and the addition of deflectors to direct the flow towards the exit at the conditions required to produce the oscillatory flow.

In FIG. 7, the two power nozzles 7PN1, 7PN2 issue jets J1 and J2, respectively, which are located and oriented or angled towards the dome-shape of the chamber and deflectors D1, D2 have been added to direct the flow toward the exit EX7 at the conditions required to produce the oscillatory flow.

Figure 8:
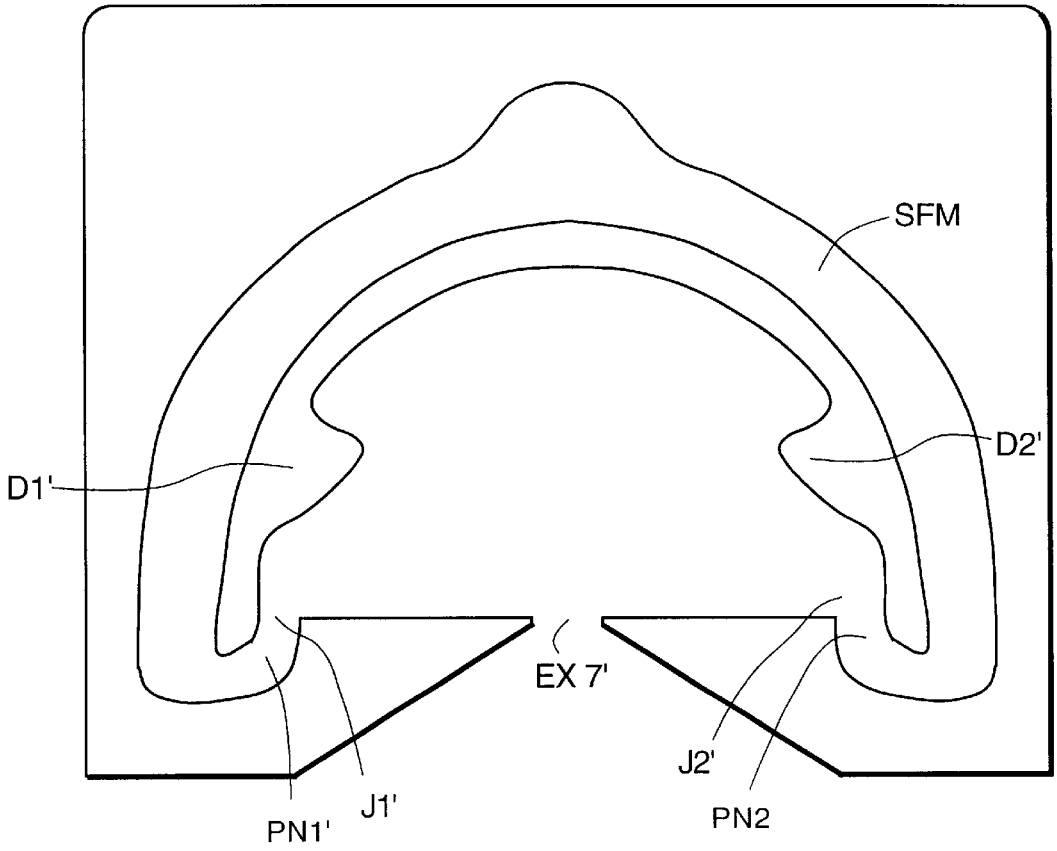
FIG. 8 is a modification of the embodiment shown in FIG. 7.

FIG. 8 is a modification of the embodiment shown in FIG. 7 with a single feed manifold SFM used with internal passages.

The embodiment shown in FIGS. 7 and 8 has a significantly lower oscillating frequency than the multiple power nozzle fluidic oscillators shown in FIGS. 1–6 and 10A–10E. Consequently, the wavelength of the oscillations is significantly longer, being about five times longer than comparable oscillators with multiple power nozzles. In this configuration, the multiple input power nozzles PN1" and PN2" are reversed in direction so as to generally head away from the outlet EX7 while still colliding in the oscillation chamber to produce oscillations in the output jet.

The exit shape for all configurations can be modified to obtain either a full or area coverage or a fan spray.

This device operates over a large range of scales of construction. Also, by a small asymmetry either in the location/orientation of the jets or in the size of the jets, the spray can be designed to have various yaw angles.

Figure 9:
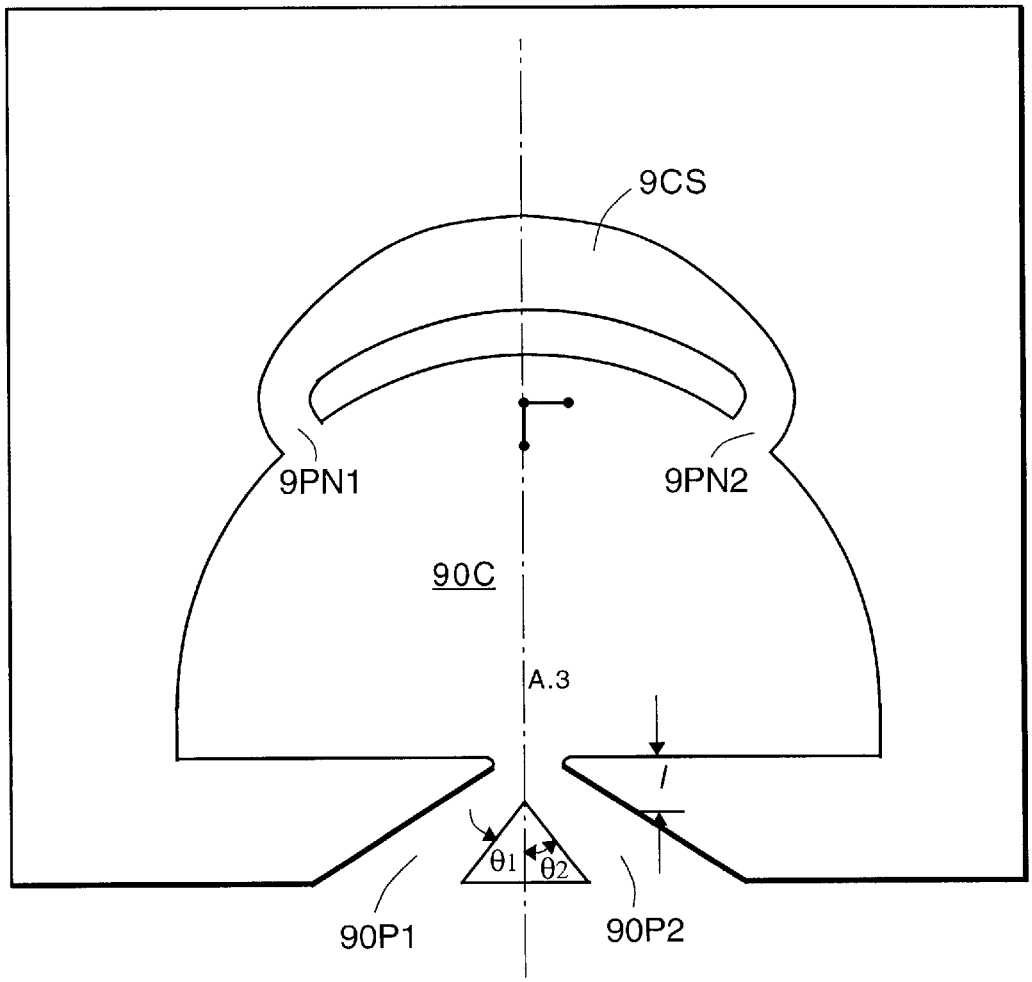
FIG. 9 illustrates a multiple power nozzle oscillator incorporating the invention and having multiple outlets.

The oscillator embodiment shown in FIG. 9 has multiple power nozzles 9PN1, 9PN2 fed from a common supply 9CS. The mushroom-shaped oscillation chamber 90C has a plurality of outlet ports 9OP1, 9OP2.

This device will produce pulsatile flow in each of the outlet ports 9OP1, 9OP-2, out of phase with each other. By varying the dimensions, angles Θ1, Θ2 and length "1", one can obtain a variety of output flows in the two ports. As an example, one could operate this device for obtaining pulsatile flows with different mass flow ratios between the two outlet ports.

Figure 11A:
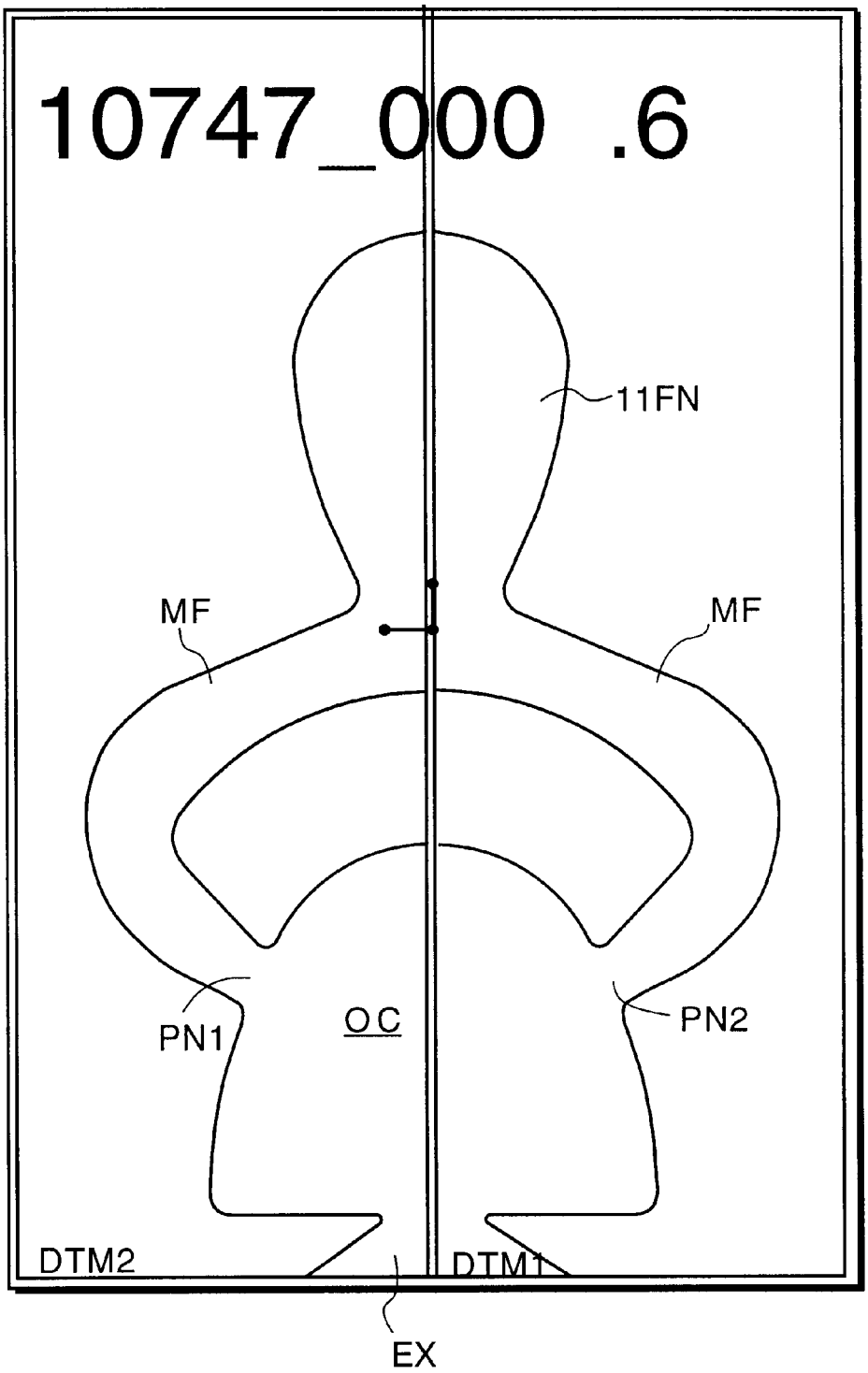
FIG. 11A illustrates a manifold for multiple power nozzles with a power nozzle feed.
Figure 11B:
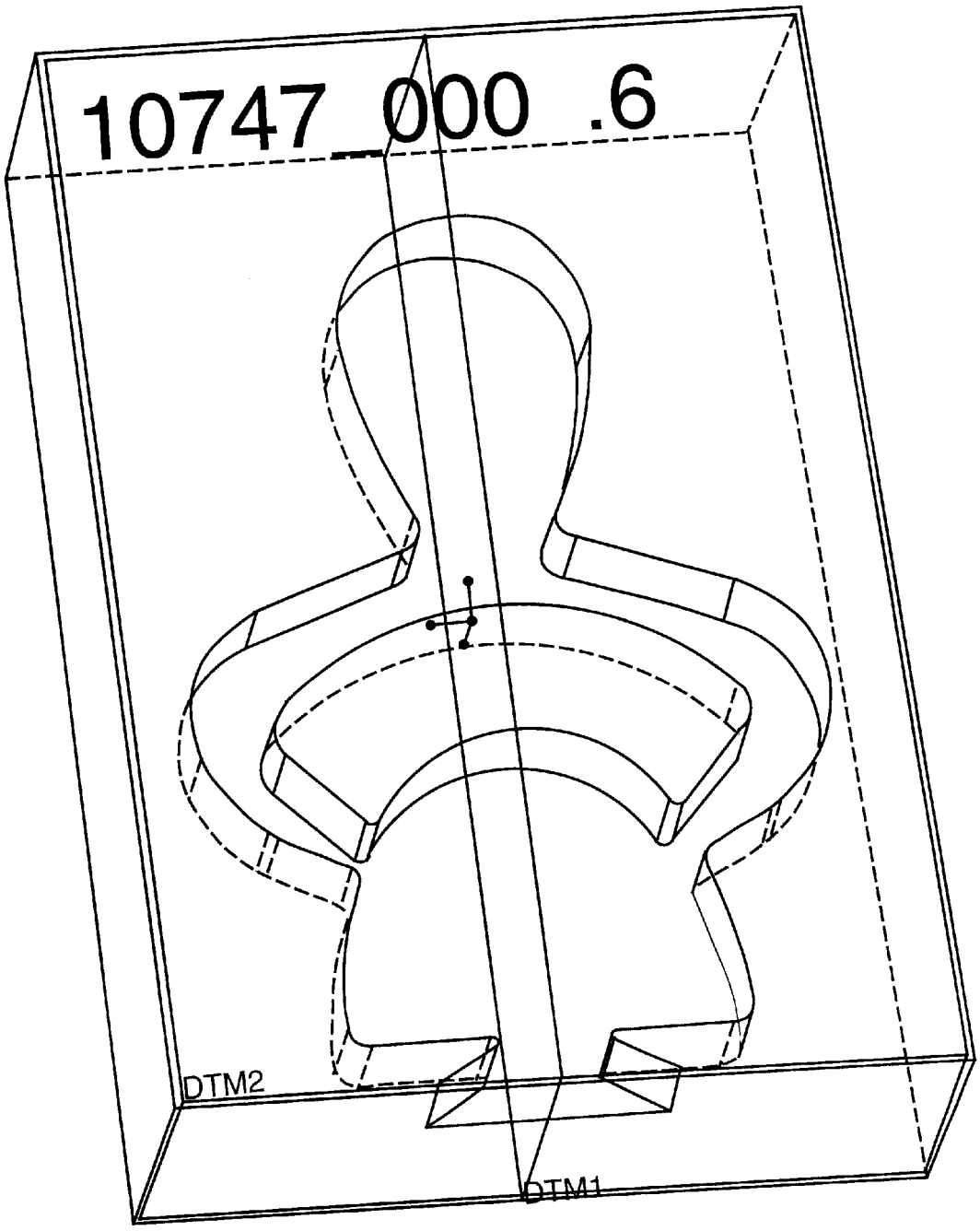
FIG. 11B is an isometric perspective view of FIG. 11A.

As is illustrated in the drawings, the circuits can be of various lengths and widths. In some cases the power nozzle length can be very small compared to the remainder of the fluidic circuit. The maximum width of the circuit is measured in terms of the power nozzle widths such as about 15 W where W is the width of a selected power nozzle. The shape of the power nozzle manifold forms one of the walls of the interaction or oscillation chamber. It can be wide or small and narrow. In some of the circuits, the length can be matched to fit existing housings. In FIGS. 11A and 11B, for example, the circuit has what can be called a "feed inlet nozzle" 11F1 leading to the power nozzle manifold.

Figure 10A:
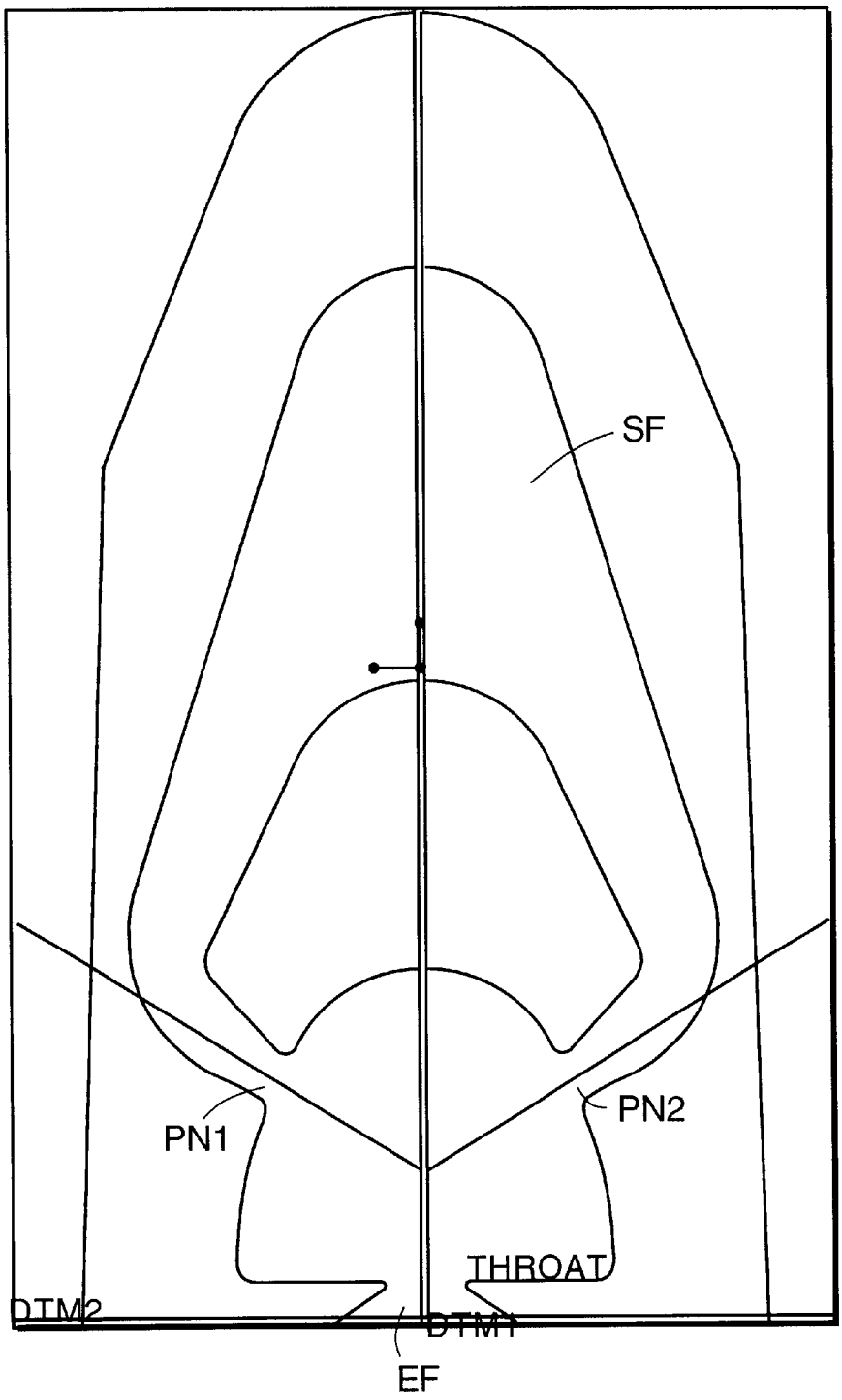
FIGS. 10A illustrates a further embodiment of the invention.
Figure 10B:
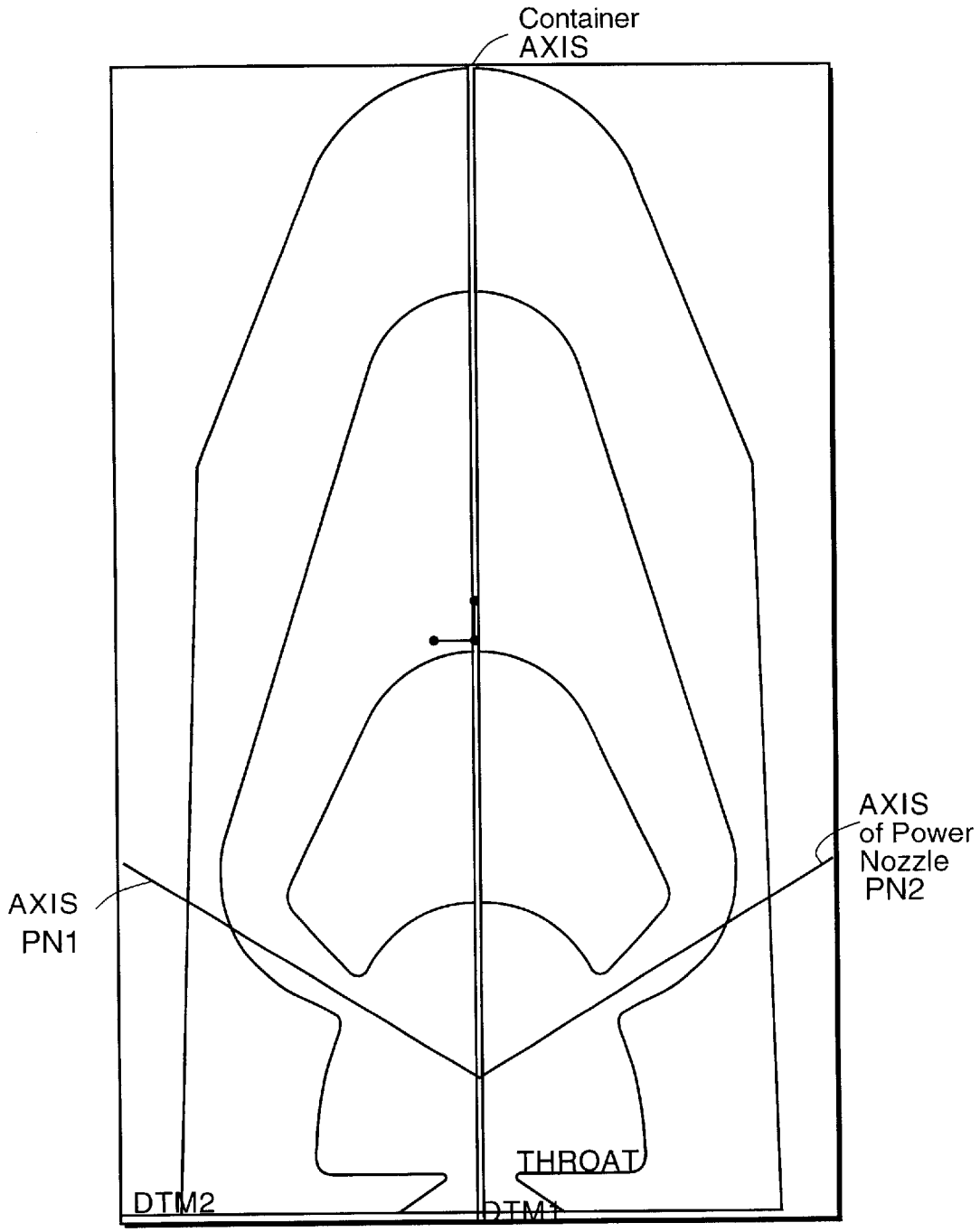
FIG. 10B illustrates a multiple power nozzle oscillator incorporating the invention with one of the power nozzles being wider than the other power nozzle to adjust the yaw angle of the spray output to ambient.
Figure 10C:
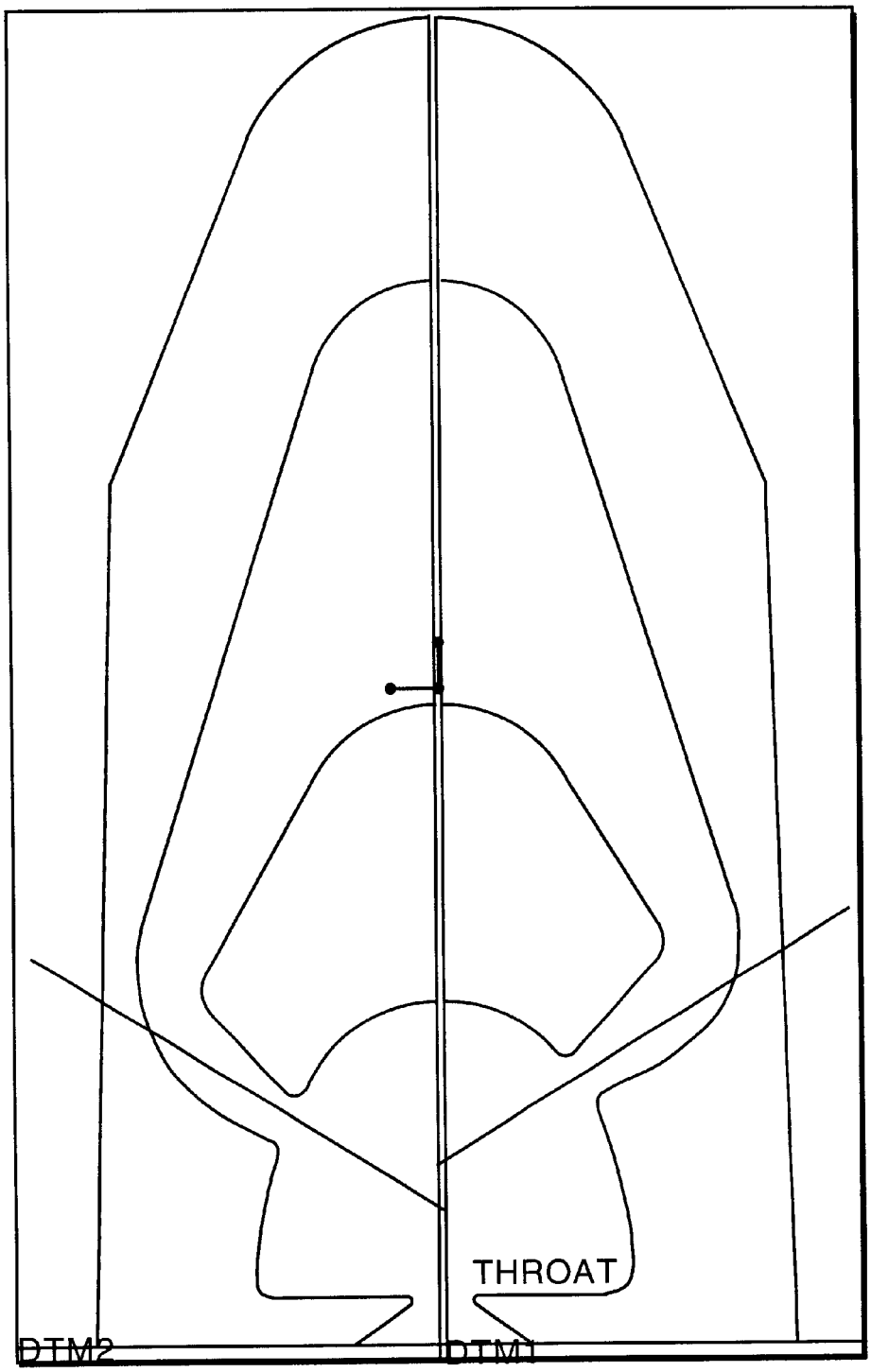
FIG. 10C illustrates a similar silhouette wherein the axes of the respective power nozzles intersect the central axis at different points.
Figure 10D:
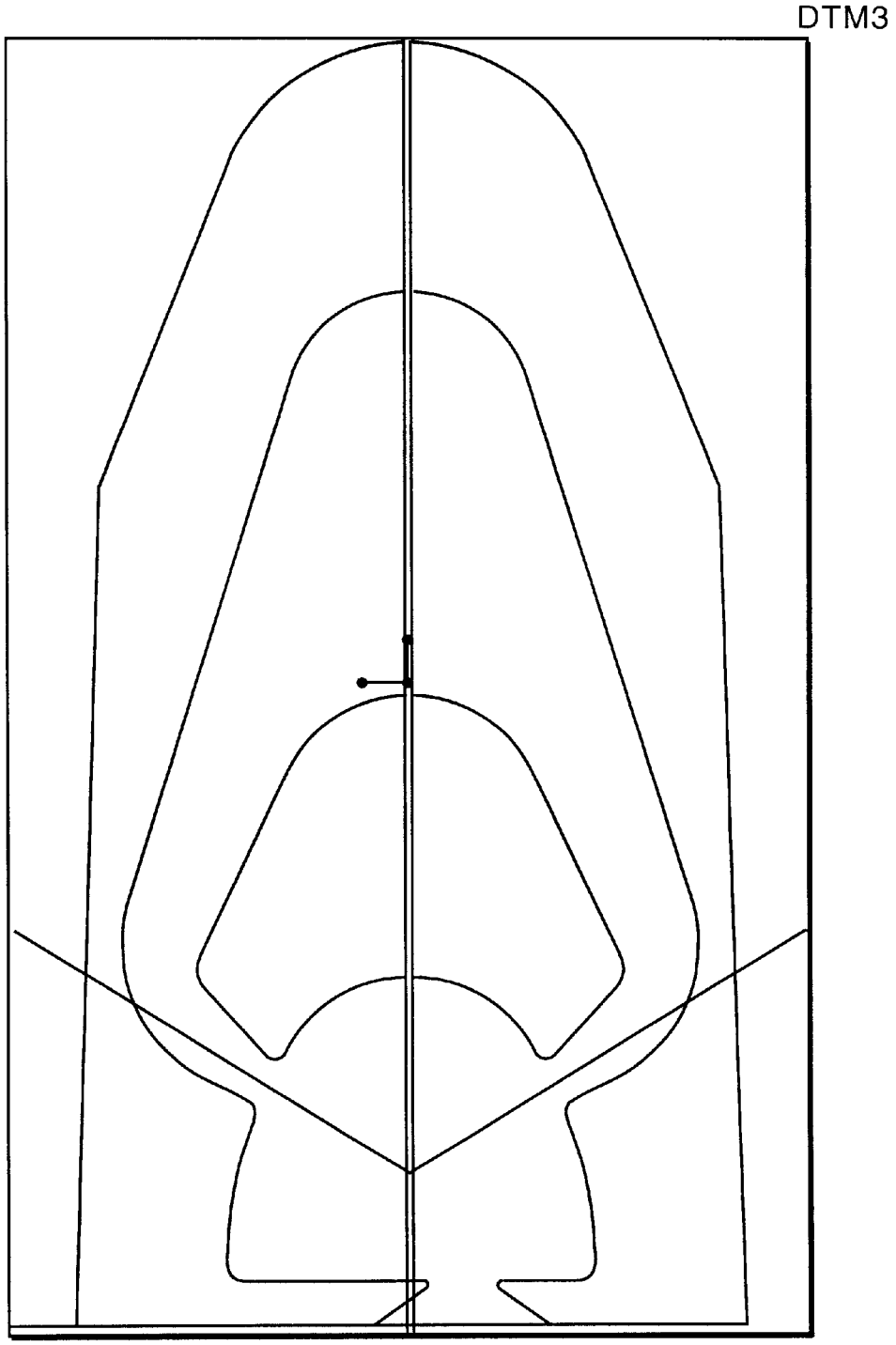
FIG. 10D is a similar silhouette wherein the outlet throat is offset (to the right in the embodiment)
Figure 10E:
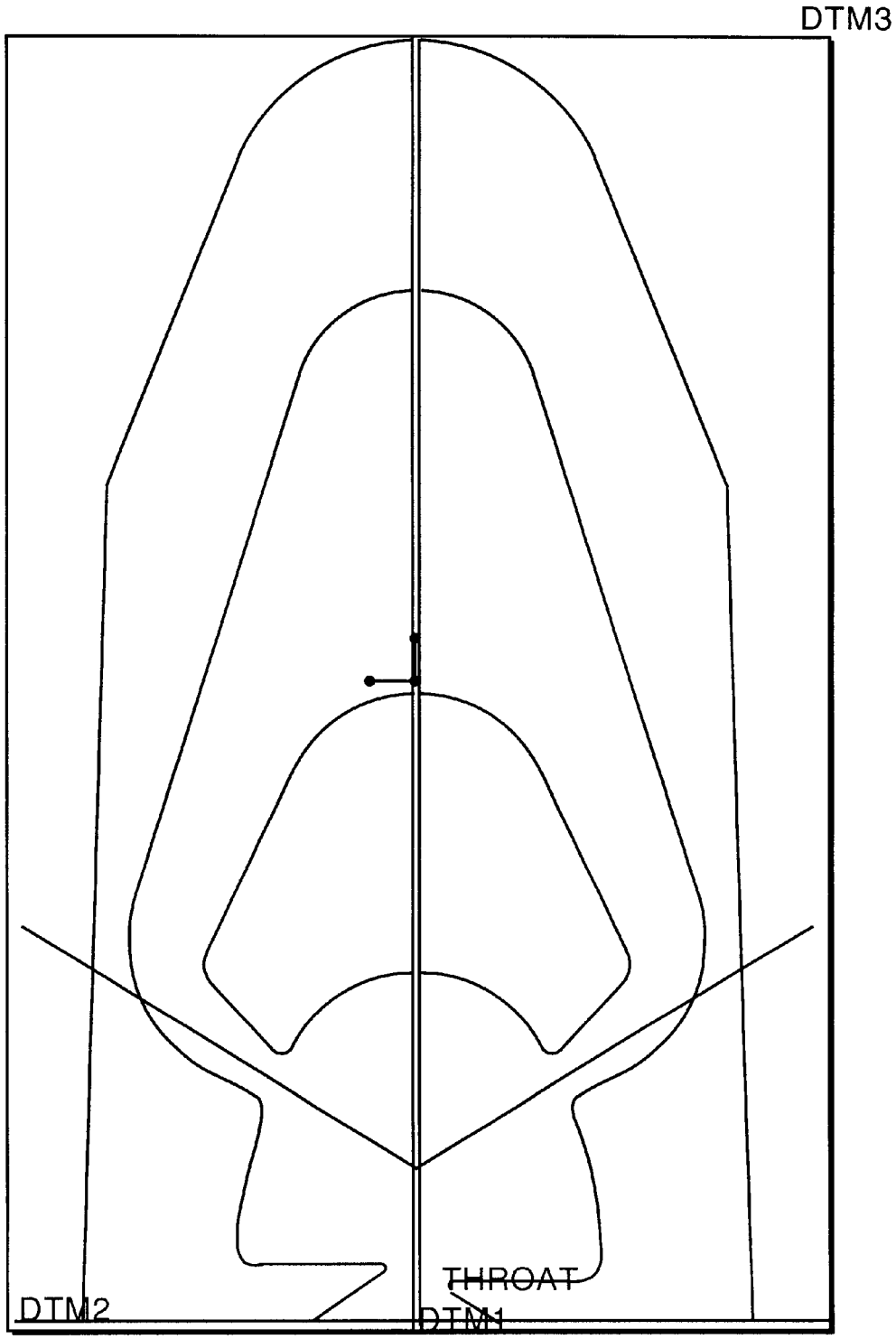
FIG. 10E is a similar silhouette showing the throat offset along the longitudinal central axis of the oscillator.

In some embodiments, the power nozzle widths can be of different widths and shapes (FIG. 10B). Again, the power nozzles can have offsets (FIG. 10C) which produce yaw angles in a fan angle to the left or right depending on the direction desired. In some embodiments, the exit throat is off axis (off the central axis of the symmetry) (FIG. 10D) by a small fraction to the left or right to move the leftward or rightward yaw angles in the spray. In some embodiments, the throat is offset along the longitudinal axis (FIG. 10E) by a small amount to produce a yaw angle of predetermined degree to the left or right depending on what is desired. Thus, one can construct circuits for yaw using a combination of the techniques described above which suits most applications.

Figure 12:
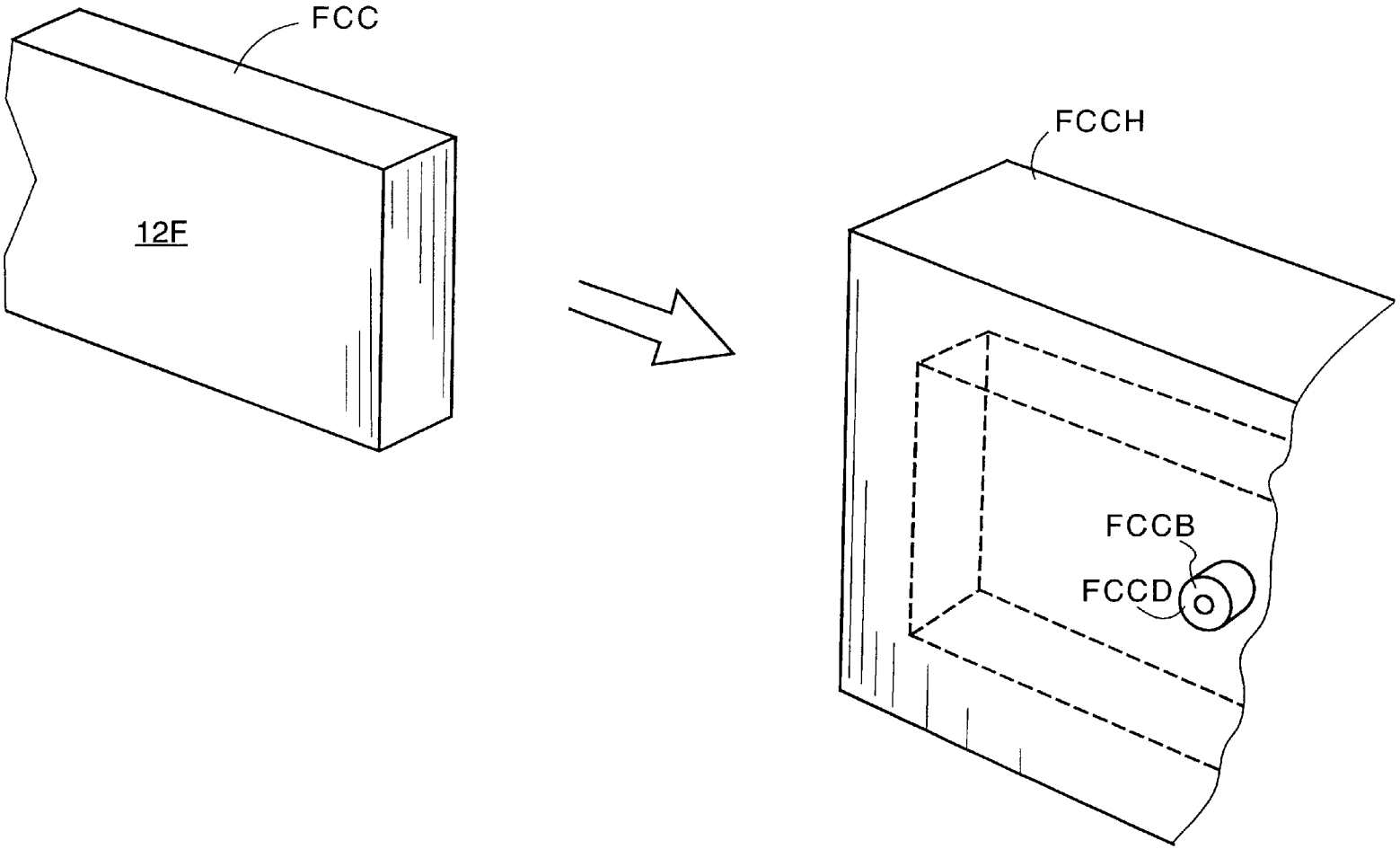
FIG. 12 illustrates a typical assembly process of a molded fluidic circuit or silhouette chip and a housing and fluid source.

Typically, the fluidic circuit or silhouette will be an injection molded plastic chip which is pressed into a molded housing having a fluid input barb in the manner disclosed in Merke et al U.S. Pat. No. 5,845,845 or Bauer U.S. Pat. No. 4,185,777. FIG. 12 shows a fluidic circuit chip FCC, having a face 12F in which one of the silhouettes or circuits shown herein has been molded, being inserted into a housing FCCH having an input barb FCCB for receiving a hose or other connection to a source of fluid under pressure. Various filters and check valves, etc. (not shown) may be included. Typical uses for the device include spraying and disbursing of fluent materials, liquids and gases. One particularly advantageous use is spray of washer liquids on glass surfaces, such as windshields, rear vehicle windows and headlamps for vehicles.

While preferred embodiments of the invention have been illustrated and described, it will be appreciated that other embodiments, adaptations and modifications of the invention will be readily apparent to those skilled in the art.

What is claimed is:

1. A method of oscillating a jet of liquid comprising:

a) providing an oscillation chamber having central axis and an outlet;

b) projecting at least a pair of power liquid jets into said oscillation chamber at selected angles relative to said central axis and induce a system of pulsating vortices in said oscillation chamber; and c) issuing one or more pulsating jets of liquid from said oscillation chamber.

2. The method defined in claim 1 wherein said one of said pair of power liquid jets is caused to have a different flow characteristic than the other of said power liquid jets and cause said pulsating liquid jet to yaw in a selected direction as it issues from said oscillation chamber.

3. The method defined in claim 1 including orienting said power liquid jets in a direction away from said outlets to produce low frequency pulsations in said one or more jets of liquid from said oscillation chamber.

4. A fluidic oscillator comprising:

a housing having an oscillation inducing chamber, at least one source of fluid under pressure, at least a pair of power nozzles connected to said at least one said source of fluid under pressure for projecting at least a pair of fluid jets into said oscillation chamber, and at least one outlet from said oscillation chamber for issuing a oxcillating jet of fluid to a point of utilization.

5. The fluidic oscillator defined in claim 4 wherein said at least one source of fluid under pressure includes a common fluid manifold connected to said at least a pair of power nozzles.

6. The fluidic oscillator defined in claim 4 wherein said oscillation inducing chamber has a central axis, and wherein said at least one outlet has a throat region leading from said oscillation chamber and said outlet throat is to one side relative to said axis.

7. The fluidic oscillator defined in claim 6 wherein said at least a pair of power nozzles are oriented at different angles relative to said axis, respectively.

8. The fluidic oscillator defined in claim 4 wherein said oscillation inducing chamber has a central axis and wherein said at least a pair of power nozzles are oriented at different angles relative to said axis, respectively.

9. The fluidic oscillator defined in claim 8 wherein said at least one outlet has an outlet throat region and said throat region leading from said oscillation chamber and said outlet throat is offset relative to said central axis.

10. The fluidic oscillator defined in claim 4 wherein said oscillation chamber has a central axis and one of said power nozzles is offset along said central axis relative to the other of said pair of power nozzles.

11. The fluidic oscillator defined in claim 10 wherein said outlet throat region is bounded by oscillation chamber walls which are offset along said central axis.

12. The fluidic oscillator nozzle defined in claim 4 wherein one of said at least a pair of power nozzles has a larger width than the other of said pair of power nozzles.

13. The fluidic oscillator defined in claim 1 wherein said pair of power nozzles are oriented in a direction such as to generally head away from said outlet in the oscillation inducing chamber to produce low frequency oscillations in said output jet.

14. A fluidic oscillator of the type that is free of control passages comprising:

(a) an oscillation chamber having an outlet, (b) a pair of nozzles adapted to form a pair of fluid jets which are oriented at an angle in said chamber to each other such that they generate a plurality of vortices in said chamber, and said plurality of vortices causing said pair of fluid jets to cyclically change their directions and combine to produce a sweeping jet of fluid at said outlet.

15. The invention defined in claim 14 wherein said oscillation chamber has a dome shaped surface.

16. The invention defined in claim 14 wherein said oscillation chamber has a dome shaped surface and said pair of fluid jets are directed toward said outlet from the direction of said dome shaped surface.

17. The invention defined in claim 14 wherein said oscillation chamber is defined by a dome shaped wall, a straight wall, and said pair of fluid jets have axes which intersect in said chamber opposite said dome shaped wall.

18. The invention defined in claim 14 wherein said pair of jets have axes with orientation angles which intersect within said oscillation chamber.

19. The invention defined in claim 14 wherein said pair of jets have axes with orientation angles which intersect outside said oscillation chamber.

20. The invention defined in claim 14 wherein aid fluid is a liquid including a common source of said liquid under pressure and means connecting said source of liquid to said pair of nozzles.

21. The invention defined in claim 14 wherein said chamber is oval shaped.

22. The invention defined in claim 14 wherein the angles of said pair of nozzles are oriented away from said outlet and deflectors on the wall of said chamber direct fluid from said nozzles towards said outlet.

23. A fluidic oscillator having an oscillation inducing chamber and a pair of power nozzles connectable to a said source of fluid under pressure for projecting a pair of fluid jets into said oscillation inducing chamber and an outlet coupled to said oscillation inducing chamber for issuing a pulsating jet of fluid to a point of utilization.

24. The fluidic oscillator defined in claim 23 wherein said source of fluid under pressure includes a common fluidic manifold connected to said pair of power nozzles.

25. The fluidic oscillator defined in claim 23 wherein said oscillation chamber has a dome shape and said pair of power nozzles issue fluid jets which are located and angled towards said dome shape of said oscillation inducing chamber.

* * * * *